US006846230B2

(12) United States Patent
Jonas

(10) Patent No.: US 6,846,230 B2
(45) Date of Patent: Jan. 25, 2005

(54) MANUAL MACHINE TOOL

(75) Inventor: Stephan Jonas, Evanston, IL (US)

(73) Assignee: Robert Bosch GmbH, Stuttgart (DE)

( * ) Notice: Subject to any disclaimer, the term of this patent is extended or adjusted under 35 U.S.C. 154(b) by 177 days.

(21) Appl. No.: 10/220,256

(22) PCT Filed: Dec. 6, 2001

(86) PCT No.: PCT/DE01/04592

§ 371 (c)(1),
(2), (4) Date: Aug. 29, 2002

(87) PCT Pub. No.: WO02/053321

PCT Pub. Date: Jul. 11, 2002

(65) Prior Publication Data

US 2004/0014411 A1 Jan. 22, 2004

(30) Foreign Application Priority Data

Dec. 30, 2000 (DE) ..... 100 65 771

(51) Int. Cl.[7] ..... B24B 23/00

(52) U.S. Cl. ..... 451/359; 451/358; 451/158; 451/259; 451/353; 451/548

(58) Field of Search ..... 451/357–359, 451/524, 557, 158, 259, 353, 548

(56) References Cited

U.S. PATENT DOCUMENTS 2,707,357 A 5/1955 Osman
4,435,923 A 3/1984 Regina
4,527,360 A 7/1985 Dicke
5,335,455 A 8/1994 Bergner
6,306,024 B1 * 10/2001 Kai et al. ..... 451/357
6,478,663 B1 * 11/2002 Ganser ..... 451/271

FOREIGN PATENT DOCUMENTS

DE 93 20 393.4 7/1999

* cited by examiner

*Primary Examiner*—George Nguyen
(74) *Attorney, Agent, or Firm*—Michael J. Striker

(57) ABSTRACT

In a hand power tool for surface machining, with a vibrating plate, which is suspended on a housing by vibrating elements, and with an electromotively driven eccentric drive, which is contained in the housing and sets the vibrating plate into an orbital oscillating motion, in order to produce a housing that is rather flat and short, which can be manually controlled in the same way as a grasping block, the coupling point is situated between the eccentric drive and the vibrating plate, close to the front edge of the vibrating plate, while the elastic vibrating elements engage the vibrating plate close to the opposite edge of the vibrating plate. The vibrating plate is affixed to the housing in the region between the coupling point and the engagement points of the vibrating elements by means of a movement transmission mechanism, which is flexurally flexible at one end and which converts the orbital motion of the vibrating plate, which is generated at the coupling point, into a reverse orbital motion at the engagement points (FIG. 2).

9 Claims, 5 Drawing Sheets

MANUAL MACHINE TOOL

BACKGROUND OF THE INVENTION

The invention is based on a hand power tool for surface machining.

In a known hand power tool of this kind (DE 93 20 393 U1), also known as a delta sander due to its triangular vibrating plate and the triangular vibrating dish attached to it, the housing is composed of a cylindrical handle part, which contains the electric motor and is aligned parallel to the vibrating plate and a gearhead attached to the handle part as an angle head, which contains the eccentric mechanism driven by the electric motor. The drive shaft of the eccentric mechanism, which is aligned at right angles to the motor axis, is connected to the driven shaft of the electric motor by means of a flexible shaft. The eccentric pin protrudes from the underside of the gearhead and protrudes into the vibrating plate approximately at the center of the vibrating plate; the eccentric pin and the vibrating plate are coupled to each other by means of a radial bearing, which permits a relative rotation between the eccentric pin and the vibrating plate. The triangular vibrating plate covers the underside of the gearhead and protrudes, with its tip toward the front, beyond the gearhead. The vibrating plate is connected to the triangular grinding plate to which triangular abrasive sheets can be attached by means of a hook-and-loop fastener.

SUMMARY OF THE INVENTION

The hand power tool according to the invention, for abrasive surface machining, has the advantage that the shifting forward, according to the invention, of the coupling point between the eccentric pin and the vibrating plate away from the center into the vicinity of an edge of the vibrating plate, which position, when the vibrating plate is embodied as triangular, is constituted by the triangle vertex of the vibrating plate, the electric motor can be placed above the vibrating plate, with its motor axis aligned parallel to the vibrating plate and thus a rather flat housing with an extremely short overall length can be achieved, whose contours remain largely within the vicinity of the vibrating plate. The housing, which can be embodied as a kind of grasping block because it is flat and short, also offers the advantage that the axial grinding pressure that the user exerts on the housing is transmitted in an ergonomically favorable fashion uniformly to all regions of the vibrating plate and thus achieves a favorable grinding result largely without fatigue. The grinding result is further improved qualitatively by an optimal grinding motion of the vibrating plate, particularly at its edges, which motion is constrained by the movement transmission mechanism in the region of the grinding plate remote from the coupling point. Despite the low height and overall length of the housing, it is not necessary to use extremely low-volume special motors; Instead conventional standard electric motors can be used, which represents a cost advantage.

According to an advantageous embodiment of the invention, the coupling point between the eccentric pin and the vibrating plate is disposed on the longitudinal center line of the vibrating plate and the engagement points of the vibrating elements on the vibrating plate are disposed the same lateral distance from the longitudinal center line. As a result of this structural measure, the vibrating plate executes vibrating movements of the same magnitude on both sides of the longitudinal center line.

According to an advantageous embodiment of the invention, the movement transmission mechanism is embodied as a torsionally flexible strut, which is flexurally flexible only in the direction of the longitudinal center line of the vibrating plate, and is fastened at one end to the vibrating plate symmetrical to the longitudinal center line and is fastened at the other end to the housing. In order to achieve the flexural flexibility only in the direction of the longitudinal center line, the strut is embodied as rectangular, with two long sides and two short sides, and is disposed so that the short sides extend parallel and are disposed the same lateral distance from the longitudinal center line of the vibrating plate.

According to an alternative embodiment of the invention, the movement transmission mechanism has two fastening elements spaced apart from each other, disposed so that they are mirror-symmetrical, lateral to the longitudinal center line of the vibrating plate, which are rigidly fastened to the housing at one end and each protrude with their other end into a respective oblong hole embodied in the vibrating plate. Each oblong hole extends with its greater hole axis parallel to the longitudinal center line of the vibrating plate and has a smaller hole axis that is slightly greater in size than the outer diameter of the section of the fastening element protruding into the oblong hole so that this fastening element is guided in the oblong hole parallel to the longitudinal center line of the vibrating plate.

BRIEF DESCRIPTION OF THE DRAWINGS

The invention will be explained in detail in the description below, in conjunction with exemplary embodiments shown in the drawings.

DESCRIPTION OF THE PREFERRED EMBODIMENTS

Figure 1:
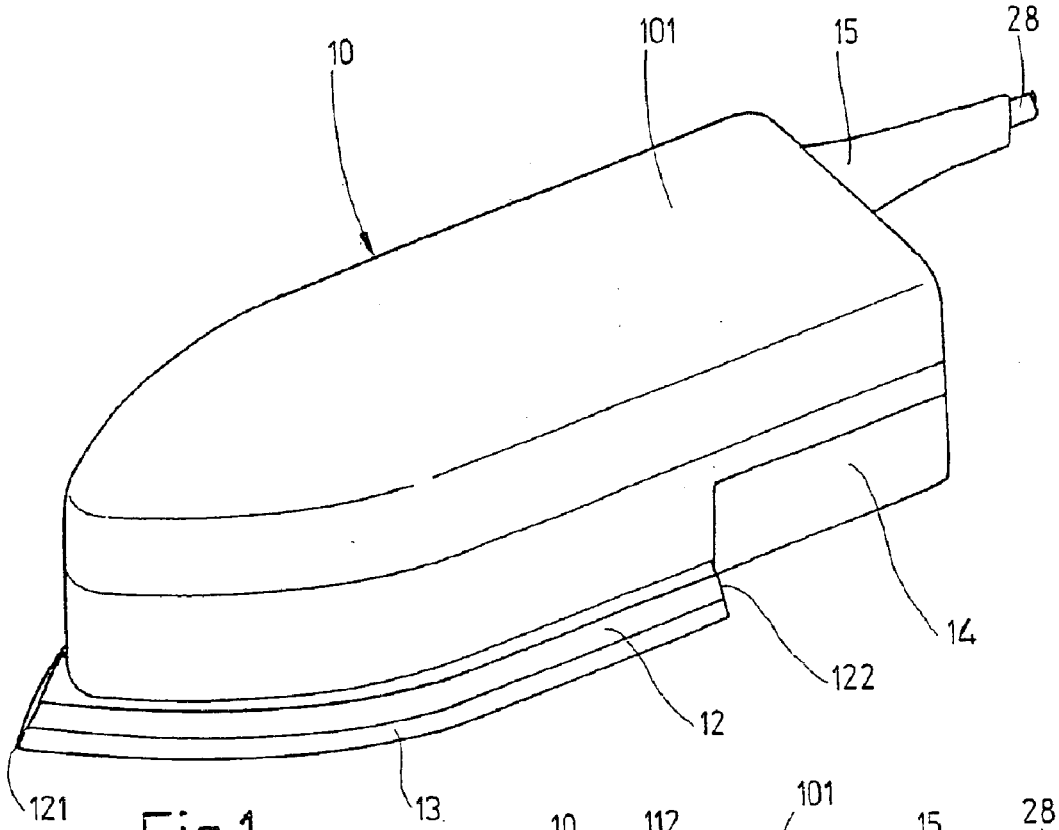
FIG. 1 shows a perspective view of an orbital sander.
Figure 2:
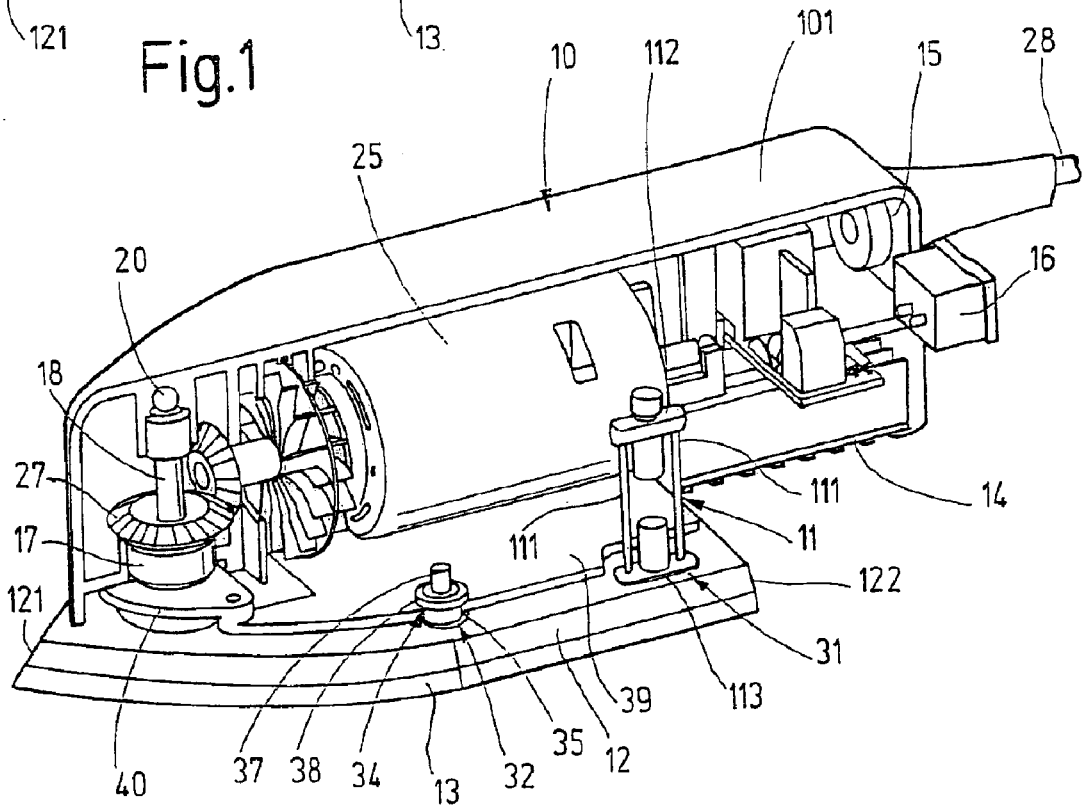
FIG. 2 shows the same view as FIG. 1 of the orbital sander, but in a sectional view along its longitudinal axis.
Figure 3:
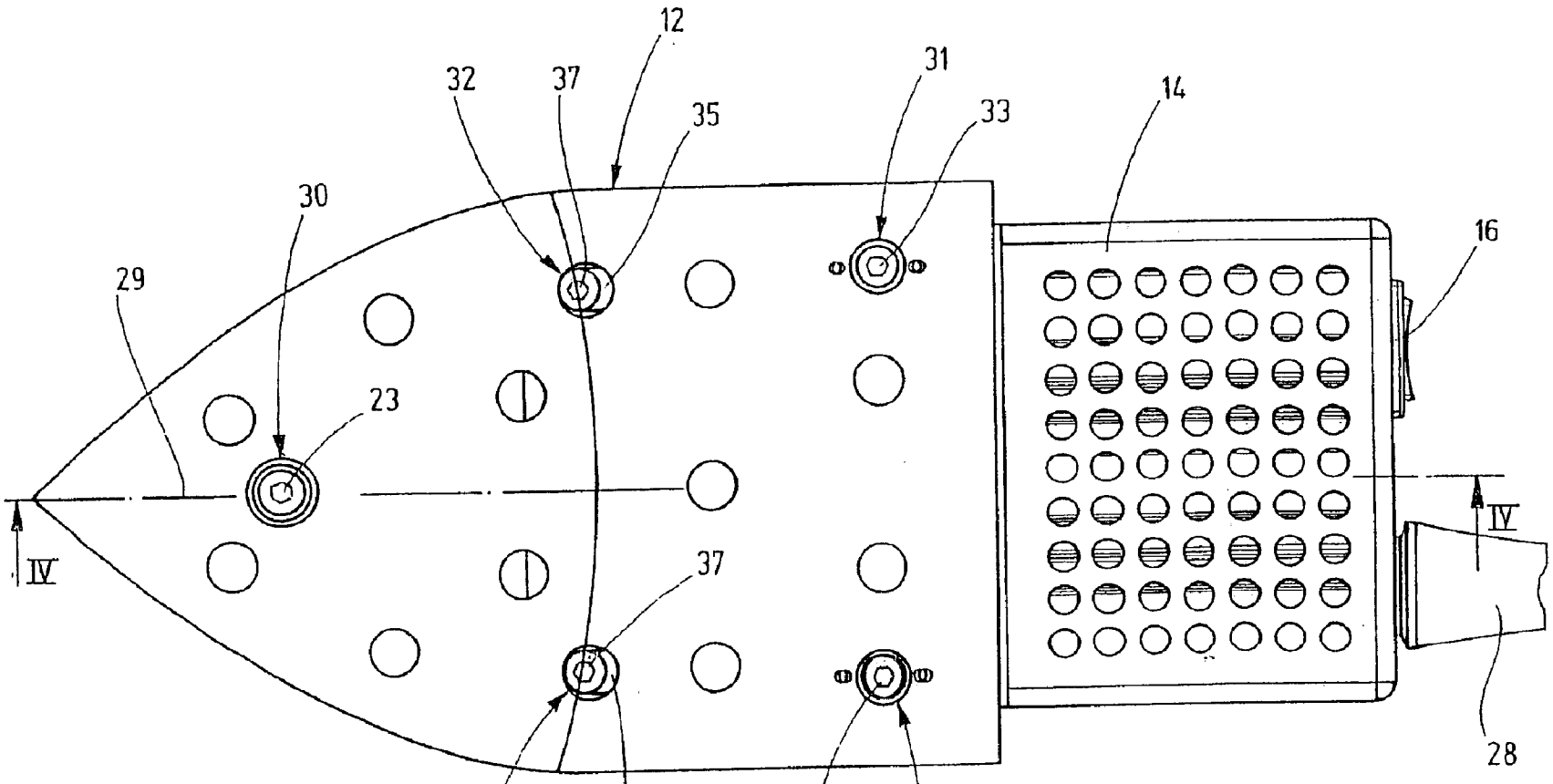
FIG. 3 shows a bottom view of the orbital sander in FIGS. 1 and 2.
Figure 4:
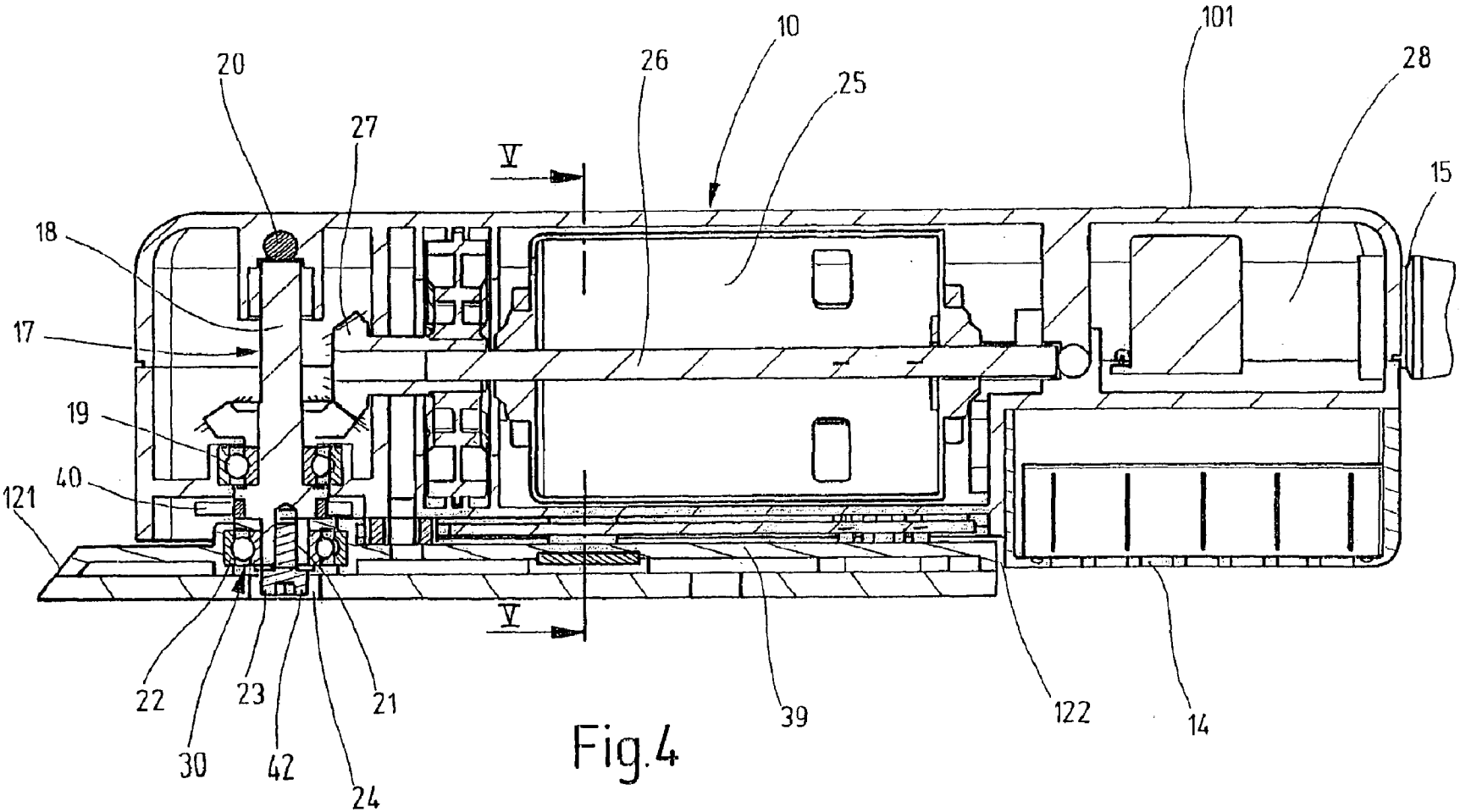
FIG. 4 shows a section along the line IV—IV in FIG. 3.
Figure 5:
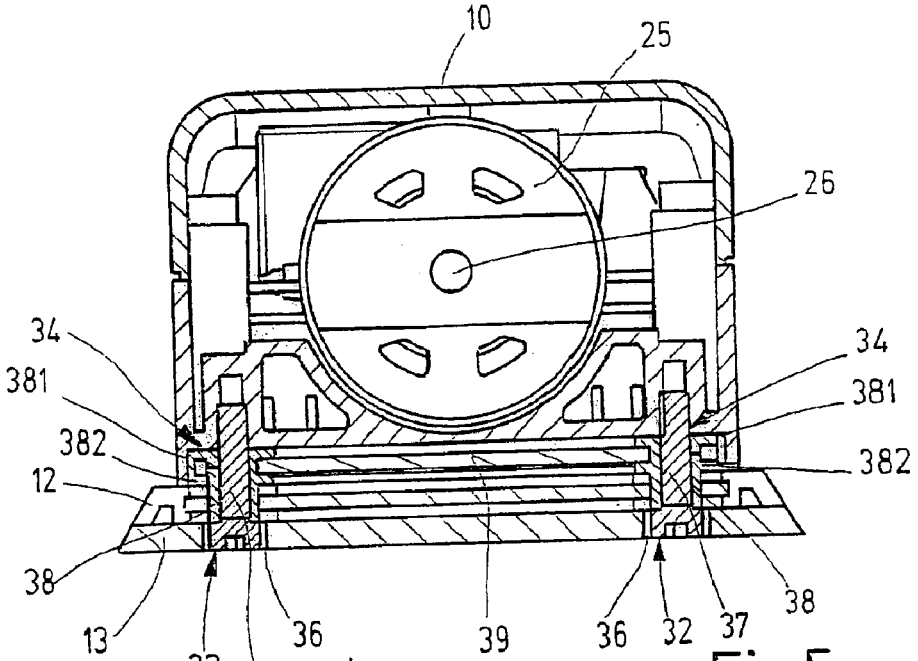
FIG. 5 shows a section along the line V—V in FIG. 4.

The orbital sander, which is depicted in a perspective view in FIGS. 1 and 2 and in various views and sections in FIGS. 3, 4, and 5 as an exemplary embodiment for a generic hand power tool for surface machining, has a housing 10, which forms a grasping block for manual control of the orbital sander so that this type of orbital sander is also referred to as an electric sanding block. On the underside of the housing 10, two elastic vibrating elements 11, one of which is shown in FIG. 2, are used to suspend a vibrating plate 12, whose underside has a grinding plate 13 connected to it, which is designed so that abrasive sheets can be detachably fastened to it. The vibrating plate 12 and grinding plate 13 are the same shape and have a front triangular section, which is embodied the same as in a so-called delta sander, and a rectangular section that adjoins the triangular section and is of one piece with it. The housing 10, which is composed of a top piece and bottom piece, is adapted in its contour approximately to that of the vibrating plate 12 and protrudes with a short housing section 101 with a rectangular base beyond the rear edge 122 of the vibrating plate 12 oriented away from the tip 121 of the vibrating plate 12. This housing section 101, which can be closed on the underside by a hood-like cover 14, contains electrical connections and electrical components such as a power cable entry 15 and an on/off switch 16. The power cable entry 15 and the on/off switch 16 are inserted into the rear of the housing section 101 by means of a corresponding opening in the wall.

The vibrating plate 12 elastically suspended on the housing 10 is set into an orbital oscillating motion by means of an eccentric drive 17. As is particularly evident from FIGS. 2 and 4, the eccentric drive 17 has a drive shaft 18, which is rotatably supported in the housing 10 at right angles to the vibrating plate 12. The support is produced by means of a radial bearing 19 and in order to be able to absorb axial forces, the drive shaft 18 is supported at its end oriented away from the vibrating plate 12 against a ball 20 movably contained in the housing 10. The drive shaft 18 is non-rotatably connected to an eccentric pin 21, which extends parallel to the drive shaft 18, offset from it radially by an eccentricity. The eccentric pin 21 is rotatably coupled to the vibrating plate 12; the coupling is produced by a radial bearing 20, whose inner bearing ring is non-rotatably supported on the eccentric pin 21 while the outer bearing ring is non-rotatably contained in the vibrating plate 12. In this connection, the inner bearing ring is supported against a radial shoulder on the eccentric pin 21 and against a securing ring 42 resting against the end of the eccentric pin 21, which securing ring is secured in place by a fastening screw 23 that is inserted through a bore 24 into the grinding plate 13 and is screwed into an axial threaded bore in the eccentric pin 21.

The eccentric drive 17 also includes an electric motor 25, whose driven shaft 26 aligned parallel to the vibrating plate 12 is driven by the drive shaft 18 by means of an angular gear 27, which is embodied in this instance as a bevel gear pair. The electric motor 25, which extends approximately to the rear edge 122 of the vibrating plate 12, is connected in the housing section 101 to a power cable 28, which is routed through the power cable entry 15, with the interposition of the on/off switch 16.

In order to achieve the compact design of the orbital sander shown in FIGS. 1 and 2, the coupling point 30 between the eccentric pin 21 and the vibrating plate 12, which is constituted by the radial bearing 22, is disposed close to the tip 121 of the vibrating plate 12 and the engagement points 31 of the two elastic vibrating elements 11 with the vibrating plate 12 are disposed close to the rear edge 121 of the vibrating plate 12. The coupling point 30 is situated on the longitudinal center line 29, while the engagement points 31 of the two elastic vibrating elements 11 are situated the same lateral distance from the longitudinal center line 29 of the vibrating plate 12. Of the identically embodied elastic vibrating elements 11, one vibrating element 11 is shown in FIG. 2. It is comprised of two parallel, torsionally and flexurally flexible rods 111, which are attached at the ends to an upper and lower bracket 112, 113. The upper bracket 112 is connected to the housing 10 and the lower bracket 113 is connected to the vibrating plate 12. The heads of the fastening screws 33, which are screwed into the lower bracket 113 for this purpose, are shown in FIG. 3.

In the region between the coupling point 30 and the engagement points 31 of the two vibrating elements 11, the vibrating plate 12 is connected to the housing 10 by means of a movement transmission mechanism 32 that is flexurally flexible at one end. The movement transmission mechanism 32 here is designed so that the orbital motion of the vibrating plate 12 generated at the coupling point 30 by the rotating eccentric pin 21 produces an opposite orbital motion in the engagement points 31 of the elastic vibrating elements 11. For the sake of clarity, the orbital motions of the coupling point 30 and the engagement points 31 are symbolically depicted in FIG. 8. During the rotation of the eccentric pin 21, whereas the coupling point 30 moves clockwise from position 1 through positions 2, 3, and 4, the engagement points 31 move counterclockwise from positions 1, 2, and 3 to position 4.

In the exemplary embodiment of the orbital sander according to FIGS. 1–5, the movement transmission mechanism 32 is comprised of two fastening elements 34, which are disposed lateral to the longitudinal center line 29 of the vibrating plate 12, spaced apart from each other, and mirror-symmetrical to the longitudinal center line 29 of the vibrating plate 12, and two oblong holes 35 disposed in the vibrating plate 12. The oblong holes 35 (FIG. 2) are spaced the same lateral distance from the longitudinal center line 29 of the vibrating plate 12 so that their greater hole axes extend parallel to the longitudinal center line 29. The smaller hole axes of the oblong holes 35 are slightly greater in size than the outer diameter of the part of the fastening element 34 protruding into the oblong hole 35 so that the fastening elements 34 are guided in the longitudinal direction in the oblong holes 35.

As shown in FIG. 5, each fastening element 34 is comprised of a cap screw 37, which is inserted through an opening 36 in the grinding plate 11 and is screwed into a threaded section in the housing 10, and a guide bush 38, which is slid onto the screw shaft and is inserted into the oblong hole 35 with its lower bush section. At the upper end oriented away from the insertion end, each guide bush 38 has two annular flanges 381, 382 spaced axially apart from each other, which each overlap one of the longitudinal edges of an unbalanced plate 39 disposed above the vibrating plate 12, spaced axially apart from it, and parallel to the vibrating plate 12, so that the unbalanced plate 39 is guided in an axially movable fashion between the annular flanges 381 and 382 of the two guide sleeves 38. The unbalanced plate 39 serves as a counterweight for balancing the orbital sander and is coupled to an eccentric plate 40 (FIGS. 2 and 4), which is driven by the drive shaft 18 in the opposite direction from the vibrating plate 12, so that it executes an oscillating motion in the opposite direction from the vibrating plate 12. The unbalanced plate 39 is cut away in the vicinity of the vibrating elements 11 (FIG. 2).

Figure 6:
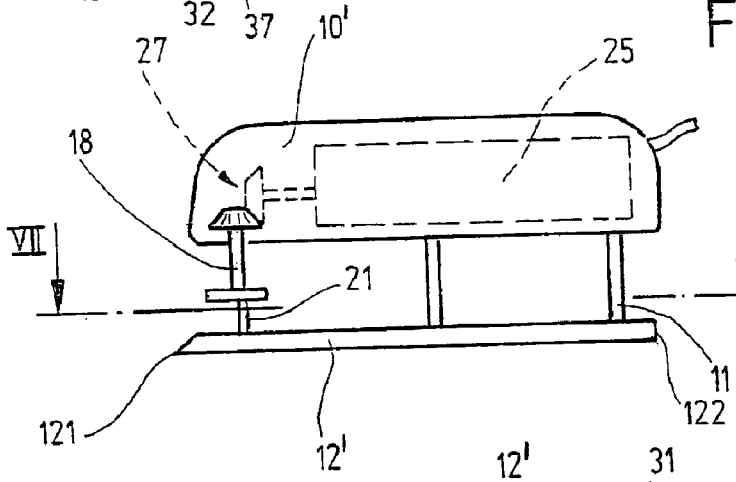
FIG. 6 shows a schematic depiction of a side view of the orbital sander according to a second exemplary embodiment.
Figure 7:
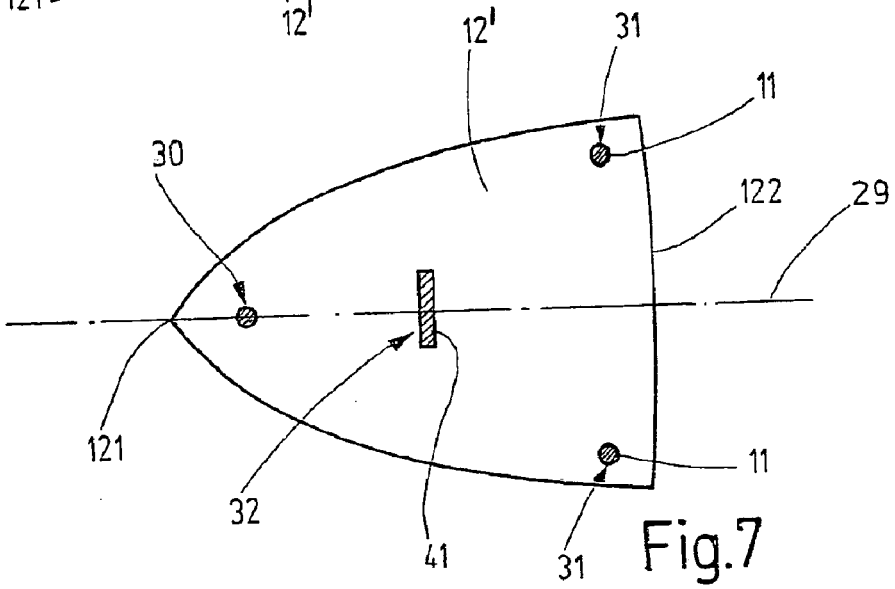
FIG. 7 shows a section along the line VII—VII in FIG. 6.

The orbital sander, which is only depicted in a schematic fashion in FIGS. 6 and 7, is modified in that the housing 10' is situated inside the contour of the vibrating plate 12' and does not protrude beyond the rear edge 122 of the vibrating plate 12'. The vibrating plate 12' is triangular, with slightly convex lateral edges. The electric motor 25, which is likewise disposed with its motor axis parallel to the vibrating plate 12, once again uses the angular gear 27 to drive the drive shaft 18 with the eccentric pin 21, which sets the vibrating plate 12' into the above-described orbital oscillating motion in the vicinity of the coupling point 30. The two vibrating elements 11, which are once again mirror-symmetrical to the longitudinal center line 29 of the vibrating plate 12' and are fastened to the vibrating plate 12' at the engagement points 31, are embodied in this instance as torsionally flexible, flexurally elastic rods. The movement transmission mechanism 32 is constituted by a torsionally flexible strut 41, which is flexurally flexible only in the direction of the longitudinal center line 29 of the vibrating plate 12' and is fastened at one end to the vibrating plate 12' symmetrical to its longitudinal center line 29 and is fastened at the other end to the housing 10'. The strut 41 is disposed centrally between the coupling point 30 and the engagement points 31. It has a rectangular cross section with two long sides and two short sides and is disposed so that the short sides extend parallel to the longitudinal center line 29 of the vibrating plate 12'.

Figure 8:
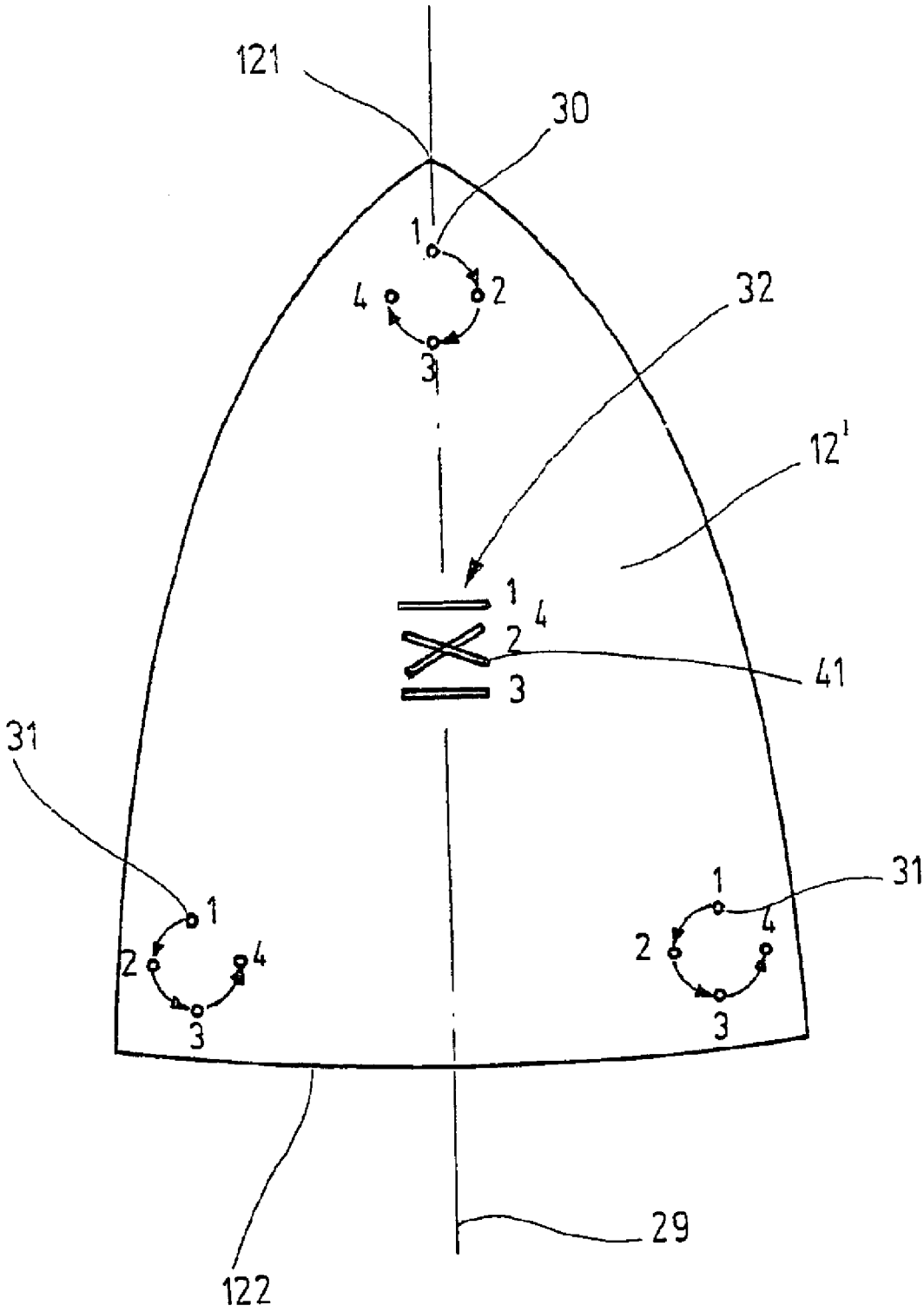
FIG. 8 shows the same depiction as FIG. 7 in order to explain the orbital oscillating motion of the grinding plate of the delta sander.

FIG. 8 shows how the orbital oscillating motion of the coupling point 30 between the eccentric pin 21 and the vibrating plate 12', which is generated by the eccentric drive 17, is converted by the strut 41 into a reverse, likewise orbital oscillating motion of the engagement points 31 of the elastic vibrating elements 11 on the vibrating plate 12'. The respective positions of the coupling point 30, the engagement points 31, and the strut 41 in the course of an orbit are indicated by the positions 1, 2, 3, and 4. In positions 1 and 3, the strut 41 is deflected in the direction of the longitudinal center line 29 of the vibrating plate 12'; in positions 2 and 4, the center strut is rotated slightly clockwise or counterclockwise. As is shown, the entire vibrating plate 12', except for the region on the strut 41 itself, executes a circular motion, which is important for good sanding results.

What is claimed is:

1. A hand power tool for surface machining, with a vibrating plate (12; 12'), which is suspended on the underside of a housing (10; 10') by means of elastic vibrating elements (11) and is for the attachment of a grinding tool, with an eccentric drive (17), which is contained in the housing (10; 10') and sets the vibrating plate (12; 12') into an orbital oscillating motion and which has a drive shaft (18) driven by an electric motor (25) and an eccentric pin (21), which is coupled to the vibrating plate (12; 12') rotatably in relation to the vibrating plate (12; 12') and is connected to the drive shaft (18) in an eccentric, non-rotatable fashion, characterized in that coupling point (30) is situated between the eccentric pin (21) and the vibrating plate (12; 12'), close to an one edge (121) of the vibrating plate (12; 12'), and the elastic vibrating elements (11) engage the vibrating plate (12; 12') close to the opposite edge (122) of the vibrating plate (12; 12'), and that the vibrating plate (12; 12') is affixed to the housing (10; 10') in the region between the coupling point (30) and the engagement points (31) of the vibrating elements (11) on the vibrating plate (12; 12') by means of a movement transmission mechanism (32), which is flexurally flexible at one end and is designed so that the orbital motion at the coupling point (30) produces a reverse orbital motion at the engagement points (31), wherein the edge (121) close to the coupling point (30) is the front edge of the vibrating plate (12; 12') in the working position and the edge close to the engagement points (31) of the vibrating elements (11) is the rear edge (122) of the vibrating plate (12; 12') in the working position.

2. The hand power tool according to claim 1, characterized in that the coupling point (30) is disposed on the longitudinal center line (29) of the vibrating plate (12; 12') and that the engagement points (31) of the vibrating elements (11) are disposed the same lateral distance from the longitudinal center line (29).

3. The hand power tool according to claim 2, characterized in that the movement transmission mechanism (32) is embodied as a torsionally flexible strut (41), which is flexurally flexible only in the direction of the longitudinal center line (29) of the vibrating plate (12') and is fastened at one end to the vibrating plate (12') symmetrical to its longitudinal center line (29) and is fastened at the other end to the housing (10').

4. The hand power tool according to claim 3, characterized in that the strut (41) has a rectangular cross section, with two long sides and two short sides, and is disposed so that the short sides extend parallel to the longitudinal center line (29) of the vibrating plate (12').

5. The hand power tool according to claim 2, characterized in that the movement transmission mechanism (32) has two fastening elements (34), which are spaced apart from each other lateral to the longitudinal center line (29) of the vibrating plate (12) and which are each rigidly fastened on one end to the housing (10) and each protrude with their other end into a respective oblong hole (35) embodied in the vibrating plate (12), whose greater hole axis extends parallel to the longitudinal center line (29) of the vibrating plate (12) and whose shorter hole axis is slightly greater in size than the outer diameter of the section of the fastening element (34) protruding into the oblong hole (35).

6. The hand power tool according to claim 1, characterized in that the electric motor (25) is disposed above and parallel to the vibrating plate (12; 12') and extends approximately to the rear edge (122) of the vibrating plate (12; 12') and that an angular gear (27), preferably a bevel gear pair, is provided in the drive train between the drive shaft (18) and a driven shaft (26) of the electric motor (25).

7. The hand power tool according to claim 6, characterized in that the housing (10) has a contour that is approximately adapted to the vibrating plate (12) and protrudes beyond the rear edge (122) of the vibrating plate (12) with a short housing section (101), which has a rectangular base and contains the electrical connections and components, such as the power cable entry (15) and the on/off switch (16).

8. The hand power tool according to claim 1, characterized in that the housing (10; 10') constitutes a manually controllable grasping block.

9. A hand power tool for surface machining, with a vibrating plate (12; 12'), which is suspended on the underside of a housing (10: 10') by means of elastic vibrating elements (11) and is for the attachment of a grinding tool, with an eccentric drive (17), which is contained in the housing (10; 10') and sets the vibrating plate (12; 12') into an orbital oscillating motion and which has a drive shaft (18) driven by an electric motor (25) and an eccentric pin (21), which is coupled to the vibrating plate (12; 12') rotatably in relation to the vibrating plate (12; 12') and is connected to the drive shaft (18) in an eccentric, non-rotatable fashion, characterized in that coupling point (30) is situated between the eccentric pin (21) and the vibrating plate (12; 12'), close to an one edge (121) of the vibrating plate (12; 12'), and the elastic vibrating elements (11) engage the vibrating plate (12; 12') close to the opposite edge (122) of the vibrating plate (12; 12'), and that the vibrating plate (12; 12') is affixed to the housing (10; 10') in the region between the coupling point (30) and the engagement points (31) of the vibrating elements (11) on the vibrating plate (12; 12') by means of a movement transmission mechanism (32), which is flexurally flexible at one end and is designed so that the orbital motion at the coupling point (30) produces a reverse orbital motion at the engagement points (31); an unbalanced plate (39), which executes a motion opposite from that of the vibrating plate (12), is disposed parallel to the vibrating plate (12), is guided in the region of the fastening elements (34), and is coupled to an eccentric plate (40), which the drive shaft (18) drives in the opposite direction from the vibrating plate (12).

* * * * *